US007291010B2

(12) United States Patent
Perlo et al.

(10) Patent No.: US 7,291,010 B2
(45) Date of Patent: Nov. 6, 2007

(54) COMBUSTION LIGHT-EMITTING DEVICE AND CORRESPONDING METHOD OF FABRICATION

(75) Inventors: Piero Perlo, Sommariva Bosco (IT); Gianfranco Innocenti, Rivalta (IT); Piermario Repetto, Turin (IT); Vito Lambertini, Giaveno (IT); Gianluca Bollito, Turin (IT); Mauro Sgroi, San Secondo di Pinerolo (IT); Mauro Brignone, Orbassano (IT); Nello Li Pira, Fossano (IT); Rossella Monferino, Turin (IT); Marzia Paderi, Turin (IT); Cosimo Carvignese, Orbassano (IT); Roberto Finizio, Orbassano (IT)

(73) Assignee: CRF Societa Consortile per Azioni, Orbassano (Torino) (IT)

( * ) Notice: Subject to any disclaimer, the term of this patent is extended or adjusted under 35 U.S.C. 154(b) by 146 days.

(21) Appl. No.: 10/998,063

(22) Filed: Nov. 29, 2004

(65) Prior Publication Data

US 2005/0142512 A1 Jun. 30, 2005

(30) Foreign Application Priority Data

Dec. 30, 2003 (IT) ..... TO2003A1046

(51) Int. Cl.
*F23D 3/40* (2006.01)

(52) U.S. Cl. ..... 431/326; 431/329; 431/170

(58) Field of Classification Search ..... 431/100, 431/268, 7, 326–9, 170; 362/179; 126/92; 355/30

See application file for complete search history.

(56) References Cited

U.S. PATENT DOCUMENTS

| | | | | |
|---|---|---|---|---|
| 3,955,556 | A * | 5/1976 | Pangborn et al. | 122/18.1 |
| 4,975,044 | A | 12/1990 | Diederich | |
| 5,137,583 | A * | 8/1992 | Parent et al. | 136/253 |
| 5,294,406 | A * | 3/1994 | Sekido et al. | 422/109 |
| 5,577,906 | A * | 11/1996 | Hanakata et al. | 431/268 |
| 5,810,577 | A * | 9/1998 | Ledjeff | 431/170 |
| 6,015,285 | A * | 1/2000 | McCarty et al. | 431/7 |
| 6,270,336 | B1 * | 8/2001 | Terashima et al. | 431/6 |
| 6,632,085 | B1 * | 10/2003 | Suzuki et al. | 431/328 |

FOREIGN PATENT DOCUMENTS

| | | |
|---|---|---|
| DE | 196 54 361 A1 | 6/1998 |
| EP | 0 846 911 A1 | 6/1998 |
| JP | 2001-172089 | 6/2001 |
| WO | WO 03/064925 A1 | 8/2003 |

* cited by examiner

*Primary Examiner*—Steven B. McAllister
*Assistant Examiner*—Chuka C Ndubizu
(74) *Attorney, Agent, or Firm*—Sughrue Mion Pllc.

(57) ABSTRACT

A light-emitting device comprises a structure defining an orderly and periodic series of cavities of nanometric dimensions, in which a process of catalytic combustion is confined. The dimensions and/or the distance between the micro-cavities are selected to obtain a light emission in the visible and prevent and/or attenuate at the same time emission of infrared radiation.

14 Claims, 5 Drawing Sheets

COMBUSTION LIGHT-EMITTING DEVICE AND CORRESPONDING METHOD OF FABRICATION

BACKGROUND OF THE INVENTION

The present invention relates to a combustion light-emitting device and to a corresponding method of fabrication.

In the current state of the art there are known various kinds of devices, in which light emission is brought about by the combustion of a liquid or gaseous fuel. Said known devices, although very widespread, are not altogether efficient, for example on account of the high emission of infrared radiation, i.e., of radiation having wavelengths not belonging to the 380-780-nm range, which constitutes the visible spectrum.

SUMMARY OF THE INVENTION

The present invention is mainly aimed at providing a combustion light-emitting device that enables selectivity in light emission to be obtained. In this general context, the specific purpose of the invention is to provide a device of this kind, in which, even though combustion is used as energy source, emission of infrared radiation is completely prevented or minimized, and the peak of light emission occurs in the visible range.

The above purpose is achieved, according to the present invention, by a combustion light-emitting device and by a method for obtaining one such light emitter having the characteristics specified in the annexed claims, which are to be understood as forming an integral part of the present description.

BRIEF DESCRIPTION OF THE DRAWINGS

Further purposes, characteristics and advantages of the present invention will emerge clearly from the ensuing detailed description and from the annexed drawings, which are provided purely by way of explanatory and non-limiting example and in which.

DETAILED DESCRIPTION OF THE INVENTION

The idea underlying the present invention is to confine a process of catalytic combustion in nanometric or submicrometric cavities of a porous, preferably highly regular, structure, specifically devised to prevent emission and propagation of infrared radiation, which represents the majority of the radiation emitted by a chemical reaction of combustion accompanied by emission of light.

In the preferred embodiment of the invention, the aforesaid porous structure is obtained via anodized porous alumina ($Al_2O_3$), having the characteristic of being transparent.

Porous alumina has a structure that can be represented ideally by a grating of hollow columns immersed in an alumina matrix. Porous alumina can be obtained via a process of anodization of high-purity aluminium foil or aluminium films on substrates such as glass, quartz, silicon, tungsten, etc.

Figure 1:
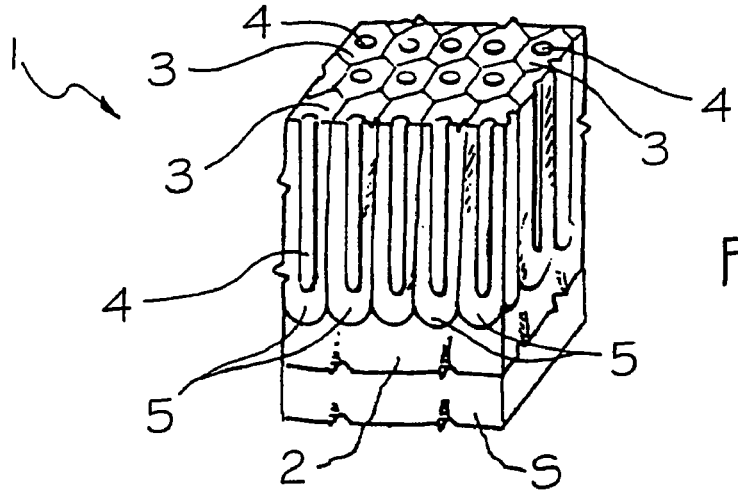
FIG. 1 is a partially sectioned, schematic, perspective view of a portion of a highly regular nanoporous structure of the photonic-crystal type, or more in general a structure which may even be non-regular but has a dense distribution of pores with diameters such as to inhibit generation and propagation of undesired radiation, said structure being usable for obtaining a device according to the invention.

FIG. 1 illustrates, merely by way of example, a portion of a film of porous alumina, designated as a whole by 1, obtained via anodic oxidation of a film of aluminium 2, set on a suitable sublayer S. As it can be noticed, the layer of alumina 1 is formed by a series of substantially hexagonal cells 3 directly adjacent to one another, each having a straight central hole which constitutes a pore 4, substantially perpendicular to the surface of the sublayer S. The end of each cell 3 that corresponds to the layer 2 has a closing portion having a substantially hemispheric geometry. The ensemble of the closing portions constitutes, as a whole, a non-porous part of the film 1, or barrier layer, designated by 5.

The film 1 can be developed with a controlled morphology by appropriately choosing the electrolyte and the physical, chemical and electrochemical parameters of the process: using acidic electrolytes (such as methanol+phosphoric acid, oxalic acid, sulphuric acid) and in adequate process conditions (in terms of time, voltage, current, stirring, and temperature) it is possible to obtain porous films with high regularity. For this purpose, the dimensions and the density of the cells 3, the diameter of the pores 4, and the depth of the film 1 may be varied; for example, the diameter of the pores 4, which is typically 50-500 nm, can be enlarged or restricted via chemical treatments.

Figure 2:
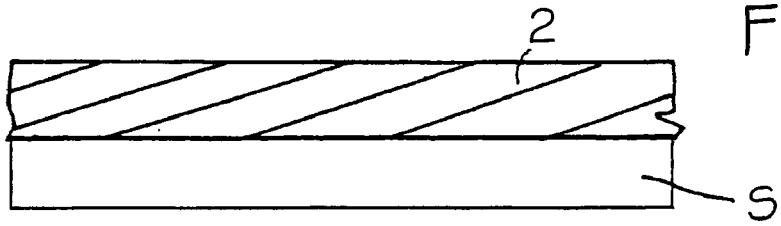
FIGS. 2-6 are respective schematic, cross-sectional views of the results of successive steps of a possible process of fabrication of a porous structure, which can be used for obtaining a device according to the invention.

As highlighted in the schematic embodiment of FIG. 2, the first step of fabrication of a film 1 of porous alumina is the deposition of a layer of aluminium 2 on a sublayer S. The operation requires a deposition of high-purity materials with thicknesses from 1 μm up to 50 μm. The preferred techniques for deposition of the layer 2 are thermal evaporation, e-beam and sputtering.

The step of deposition of the aluminium layer 2 is followed by a step of anodization of the layer itself. As has been said, the process of anodization of the layer 2 can be performed using different electrolytic solutions according to the size of and distance between the pores 4 that it is desired to obtain.

Given the same electrolyte, the concentration, current density, and temperature are the parameters that most affect the dimensions of the pores 4. The configuration of the electrolytic cell is equally important in order to obtain a correct distribution of the lines of force of the electrical field with a corresponding uniformity of the anodic process.

Figure 3:
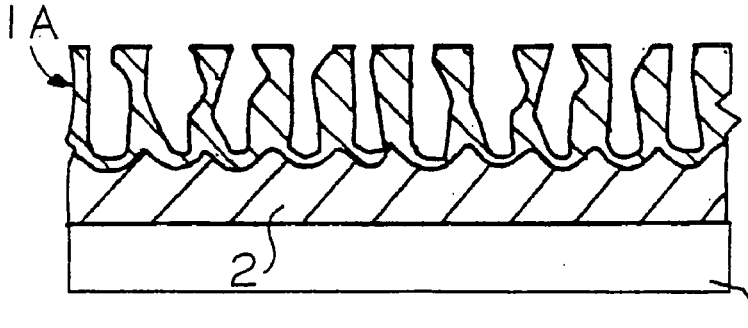
Figure 4:
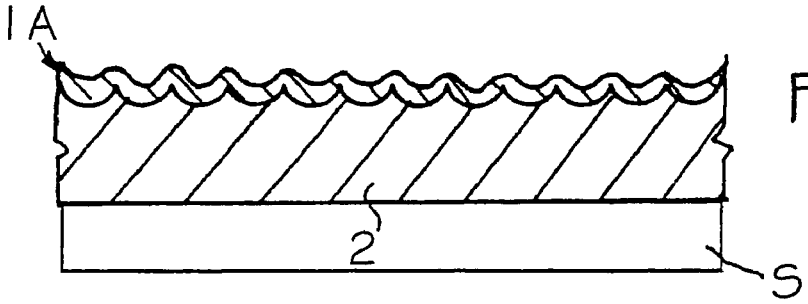

FIG. 3 is a schematic illustration of the result of the initial anodization of the layer of aluminium 2. As has been highlighted schematically, the film of alumina 1A obtained via the initial anodization of the layer 2 does not yet present a regular structure. In order to obtain a highly regular structure, of the type represented in FIG. 1, it is hence necessary to carry out subsequent anodization processes, namely, at least:

i) a first anodization, the result of which is the one illustrated in FIG. 3;

ii) a step of reduction, via chemical etching, of the irregular film of alumina 1A, obtained by means of acid solutions (for example $CrO_3$ and $H_3PO_4$); FIG. 4 illustrates schematically the layer 2 after said etching step; and iii) a second anodization of the part of alumina film 1A that has not been eliminated during the etching step.

The etching step described in point ii) is important in order to define, on the residual part of alumina 1A, preferential areas of growth of the alumina itself in the second anodization step.

Figure 5:
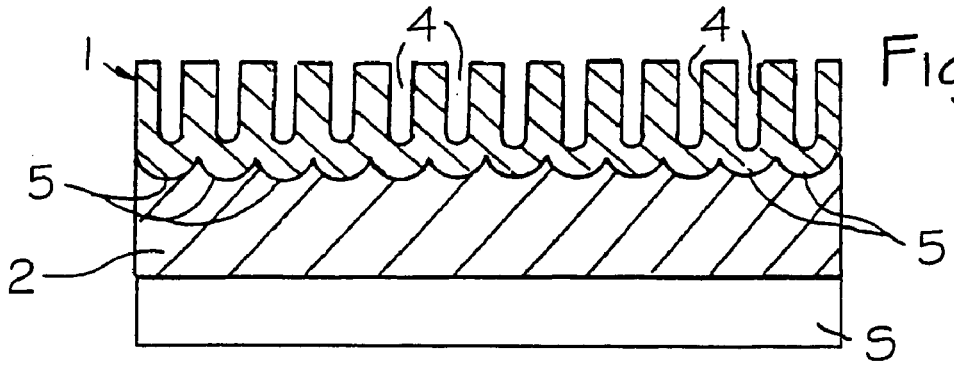

If the successive operations of etching and anodization are carried out a number of times, the structure is further improved and becomes very uniform, as highlighted schematically in FIG. 5, where the alumina film designated by 1 is now regular.

As has been said, in the nanometric or submicrometric cavities of the porous structure provided according to the invention a catalytic combustion is confined, i.e., a surface reaction that occurs in the presence of a material having the function of decreasing the activation threshold.

As is known, some metals, such as gold, platinum and palladium, are capable of functioning as catalysts for promoting a reaction of catalytic combustion. Likewise known is the fact that a process of catalytic combustion occurs only on the surface of the catalyst, is favoured by a high surface/volume ratio, proceeds at temperatures significantly lower than in the case of flame processes, and the margins of ratio between fuel and air are wider.

With reference to the case exemplified above, then, after the film 1 of anodized porous alumina has been obtained as represented in FIG. 5, a step of deposition of the catalyst, for example platinum, is carried out.

Figure 6:
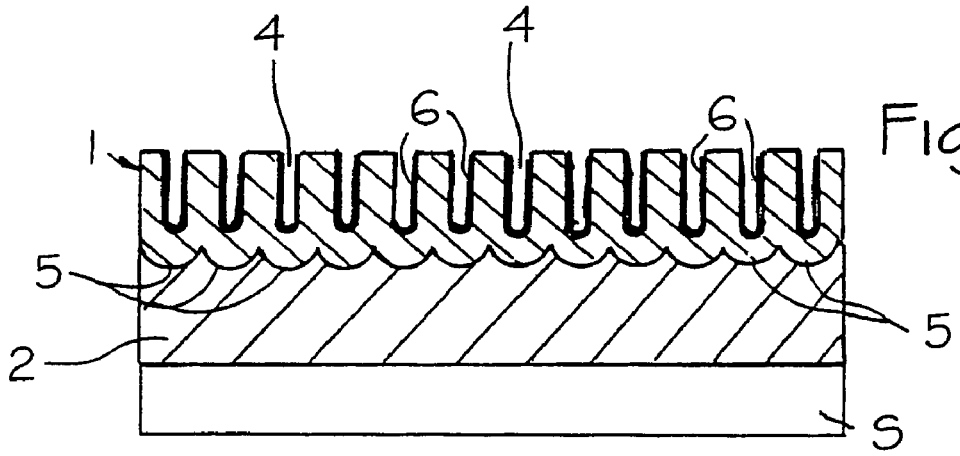

In FIG. 6, the alumina film 1 is represented following upon deposition of the catalytic material, designated by 6, which coats at least the surfaces of the pores 4.

Deposition of the catalytic material 6 inside the pores 4 of the alumina 1 can be carried out using techniques in themselves known, such as evaporation, electrolytic deposition, and impregnation. By way of example, in a possible implementation of the invention, the sputtering technique (via sputter coater) is used, which guarantees maintenance of the regularity of the structure of alumina 1 and enables the catalytic material to penetrate inside the pores 4, coating the surfaces thereof. In order to deposit the catalyst 6 there may in any case be applied also techniques of similar or equal efficiency, such as chemical vapour deposition (CVD) and physical vapour deposition (PVD). Another technique that can be used for catalytic coating may be of the pulsed type.

In general, the nanostructured sublayer may be of the vitreous metal, ceramic, or semiconductor type, such as silicon, and its nanostructuring in the two-dimensional or three-dimensional form may be obtained via techniques of lithographic etching or preferably electrolytically. Without departing from the context of the present invention, the catalytic coating has the function of triggering the process of combustion at the lowest possible temperature and can be chosen from among known inorganic-catalytic coatings or even hybrid organic-inorganic ones, and hence without necessarily resorting to costly elements, such as palladium or platinum. Once the process of reaction between the fuel and the supporter of combustion is triggered, the reaction is mainly regulated by the nanoporous structure.

Figure 7:
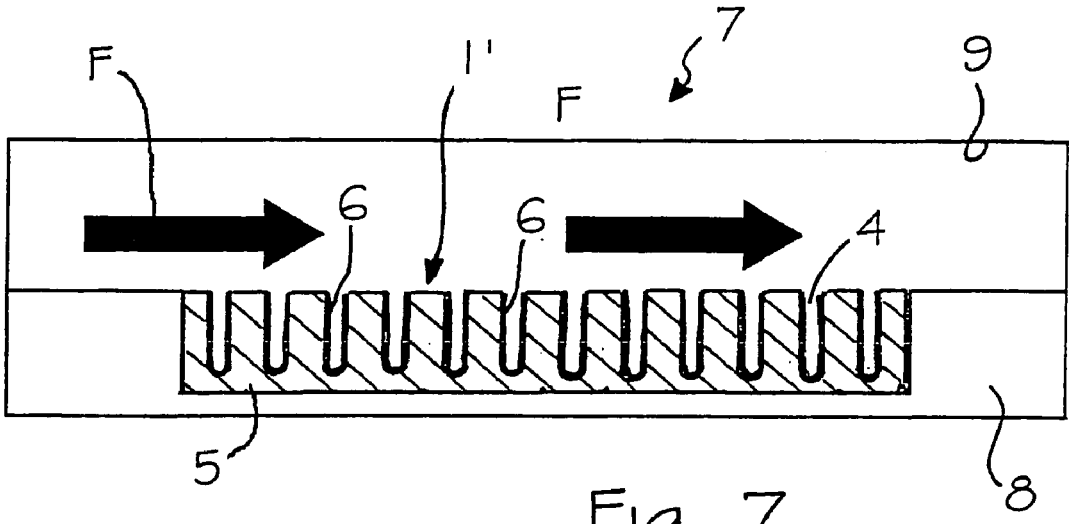
FIG. 7 is a schematic, cross-sectional view of a device according to the invention.

FIG. 7 is a schematic cross section of a light-emitting device according to the invention, designated, as a whole, by 7. In FIG. 7, the reference number 8 designates a transparent support, associated to which is the alumina film, here designated by 1', provided with the catalyst 6. In the case exemplified, and even though this is not strictly necessary for the purposes of implementation of the invention, both the sublayer S and the aluminium layer 2 have been eliminated, and the barrier layer 5 has been reduced locally, for example via etching.

Defined on top of the support 8 is a chamber or duct 9, in which there is introduced a gaseous fuel necessary for the process of catalytic combustion, represented by the arrows F, with the openings of the pores 4 of the alumina film 1' directly facing said chamber 9. In the case where the fuel is liquid, on account of the difference of pressure or the temperature in the chamber, it evaporates to react with the supporter of combustion in the pores of the nanostructured material.

The orderly porous submicrometric structure 1', in which the process of catalytic combustion is made to proceed, fulfils, according to the invention, the functions of series of submicrometric cylindrical cavities, in each of which combustion is confined, but more in general the structures can act as a photonic crystal, with the purpose of preventing or at least attenuating emission and propagation of electromagnetic waves of given wavelengths (and in particular of infrared radiation). In the specific case, the porous alumina anodized prior to the catalytic coating has, in fact, the geometrical characteristics of a two-dimensional photonic crystal with hexagonal symmetry.

The theory that underlies photonic crystals originates from the works of Yablonovitch and results in the possibility of providing materials with characteristics such as to affect the properties of photons, just as semiconductor crystals affect the properties of the electrons.

Yablonovitch demonstrated in 1987 that materials the structures of which present a periodic variation of the index of refraction can modify drastically the nature of the photonic modes within them. This observation has opened up new perspectives in the field of control and manipulation of the properties of transmission and emission of light by matter.

In greater detail, the electrons that move in a semiconductor crystal are affected by a periodic potential generated by the interaction with the nuclei of the atoms that constitute the crystal itself. This interaction results in the formation of a series of allowed energy bands, separated by forbidden energy bands (band gaps).

A similar phenomenon occurs in the case of photons in photonic crystals, which are generally constituted by bodies made of transparent dielectric material defining an orderly series of micro-cavities in which there is present air or some other means having an index of refraction very different from that of the host matrix. The contrast between the indices of refraction causes confinement of photons with given wavelengths within the cavities of the photonic crystal. The confinement to which the photons (or the electromagnetic waves) are subject on account of the contrast between the indices of refraction of the porous matrix and of the cavities results in the formation of regions of allowed energies, separated by regions of forbidden energies. The latter are referred to as photonic band gaps (PBGs). From this fact there follow the two fundamental properties of photonic crystals:

i) by controlling the dimensions, the distance between the cavities, and the difference between the refractive indices, it is possible to prevent spontaneous emission and propagation of photons of given wavelengths; in particular, the diameter of the cavities determines the likelihood of spontaneous emission, and the periodicity of the cavities, or grating pitch, determines the position of the photonic band gap;

ii) as in the case of semiconductors, where there are present dopant impurities within the photonic band gap, it is possible to create allowed energy levels.

According to the invention, the aforesaid properties of photonic crystals are basically exploited to obtain micro-cavities with highly reflecting walls, within which the catalytic combustion is confined, and in which the frequencies that are not able to propagate on account of the band gap are reflected; the surfaces of the micro-cavities hence operate as mirrors for the wavelengths belonging to the photonic band gap.

The process of confined catalytic combustion, provided according to the invention, can be described by the following reaction:

$$A+B \rightarrow C+D+hv+\epsilon$$

where A and B represent the fuel and the supporter of combustion (comburent), C and D the final elements of the reaction, the term hv represents the light radiant emission developed according to the catalytic combustion in the micro-cavities, and $\epsilon$ represents the energy emitted in the form of thermal radiation.

The anodized porous alumina is partially transparent and hence enables the wavelengths allowed by the geometry of the micro-pores 4 to be transmitted outside.

Figure 8:
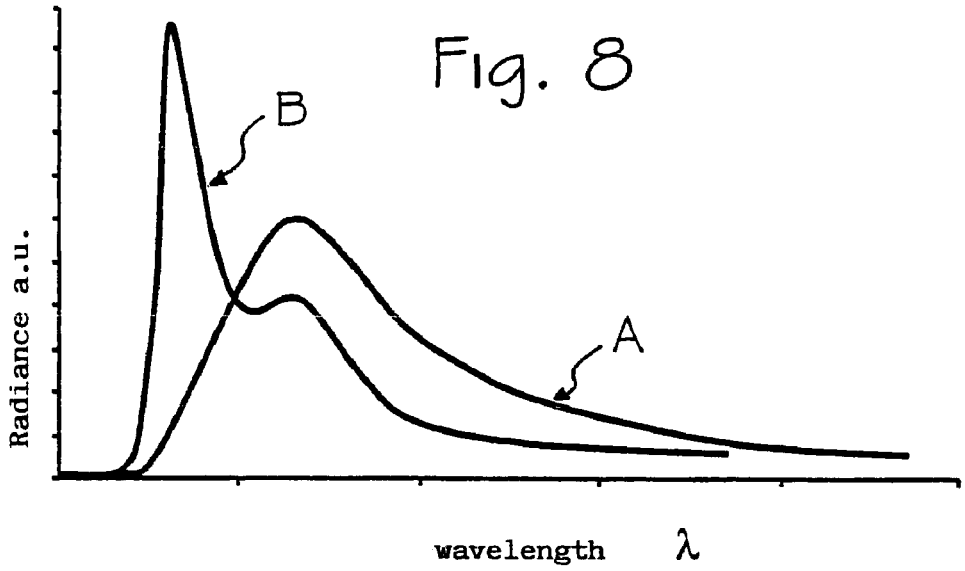
FIG. 8 is a graph showing the spectral emission that develops during a process of catalytic combustion in non-confinement conditions (curve A) and the spectral emission that develops during a process of catalytic combustion in conditions of confinement in nano-cavities, according to the invention.

From the graph of FIG. 8, it may be noted how the curve designated by A, which represents the light emission that develops during a process of catalytic combustion in non-confinement conditions, has a trend according to the black-body curve. In the case of the present invention, as emerges from curve B, the energy spectral density presents, instead, a peak which derives from the spatial confinement of the catalytic process and is located in a spectral band depending upon the geometrical conditions of the micro-cavity (by way of exemplifying reference regarding enhancement of spontaneous emission in the optical band in micro-cavities see the article "*Anomalous Spontaneous Emission Time in a Microscopic Optical Cavity*", Physical Review Letter, Volume 59, No. 26, 28 Dec. 1987).

In particular, in the case of submicrometric cylindrical cavities, as in the embodiment of the invention described herein, the following relations are valid:

allowed spectral band: $\lambda<1,7$ d forbidden band: $\lambda>1,7$ d where d is the diameter of the micro-cavities or, in more general terms, the distance between the respective reflecting walls.

In a preferred embodiment of the invention, after the film of regular porous alumina has been obtained, a step of total or localized elimination of the barrier layer 5 is carried out in such a way that the pores 4 will be open at both ends. The aforesaid process of elimination or reduction of the barrier layer 5 may envisage two successive steps:

widening of the pores 4, performed in the same electrolyte as for the preceding anodization, without passage of current;

reduction of the barrier layer 5, performed by means of passage of a very low current in the same electrolyte as for the preceding anodization; in this step, the equilibrium typical of anodization is not reached, so that the etching process as against the process of formation of the alumina is favoured.

Figure 9:
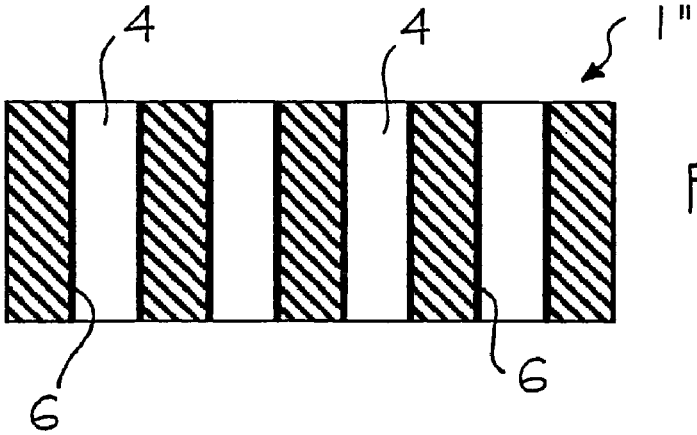
FIGS. 9 and 10 are schematic illustrations, in cross-sectional view and in perspective view, respectively, of a porous structure which can be used for obtaining a device according to the invention.
Figure 10:
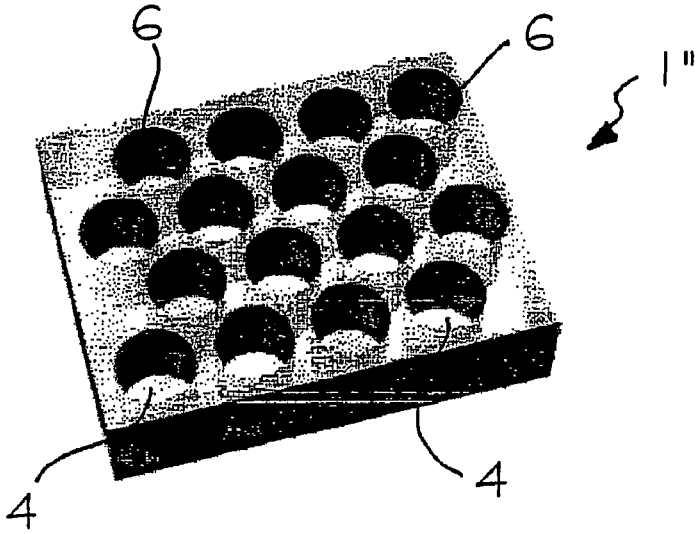

FIGS. 9 and 10 represent, in fact, in a schematic way, a portion of an alumina film 1", the pores 4 of which, coated by the catalyst 6, are open at both ends following upon elimination of the barrier layer 5.

The step of reduction/elimination of the barrier layer 5 can be performed both before and after deposition of the catalyst 6, i.e., following upon the step represented in FIG. 5 or else following upon the step represented in FIG. 6.

Figure 11:
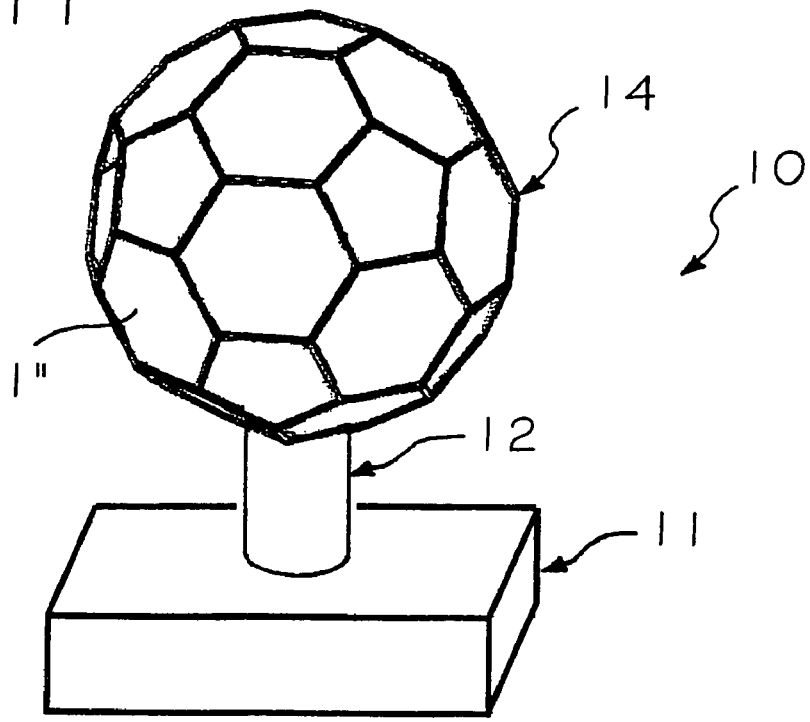
FIGS. 11 and 12 are schematic illustrations, in perspective view and in cross-sectional view, respectively, of a device according to the invention, which uses a porous structure of the type represented in FIGS. 9 and 10.
Figure 12:
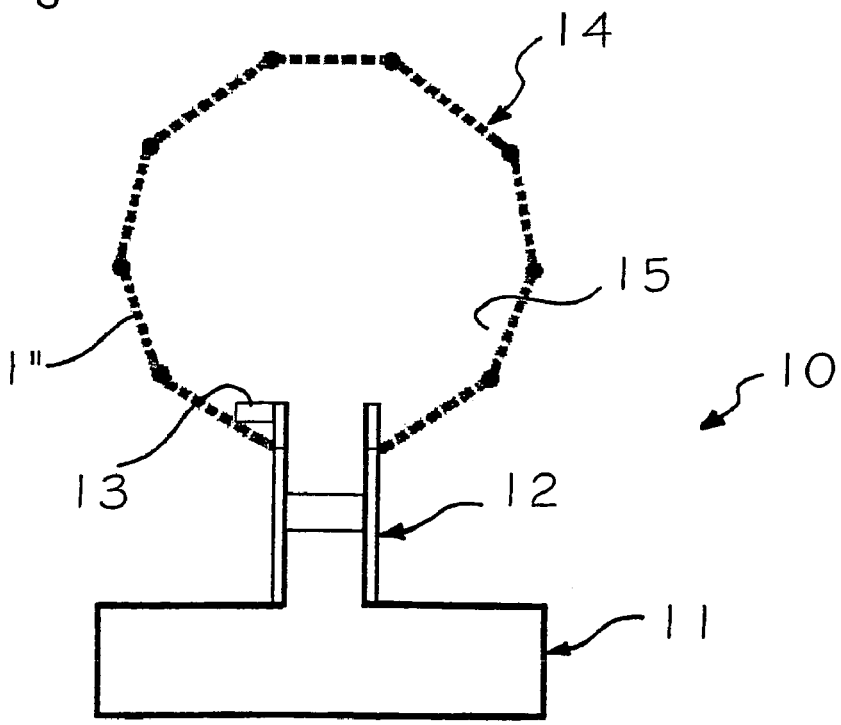

By way of non-limiting example, FIGS. 11 and 12 are schematic representations of a further possible embodiment of a device obtained according to the invention, in which the pores 4 of the porous structure used are open at both ends. The device illustrated, designated, as a whole, by 10, comprises: a fuel tank, designated by 11; a system for conveying and supplying the fuel, designated as a whole by 12; a turning-on/turning-off system, designated by 13, of an electronic or electromechanical type or, more in general, of a pressure or rubbing-action type; and a porous structure or emitter in a strict sense, designated by 14, obtained as described previously, i.e., in such a way as to comprise micro-cavities having highly reflecting walls provided with the catalyst.

In the case exemplified, the emitter 14 comprises a honeycomb framework, which supports walls formed by or in any case comprising porous structures 1" provided with catalyst, to form a spherical chamber 15. More in general, the radiation can exit from a sublayer having a plane surface or from a curved sublayer.

Figure 13:
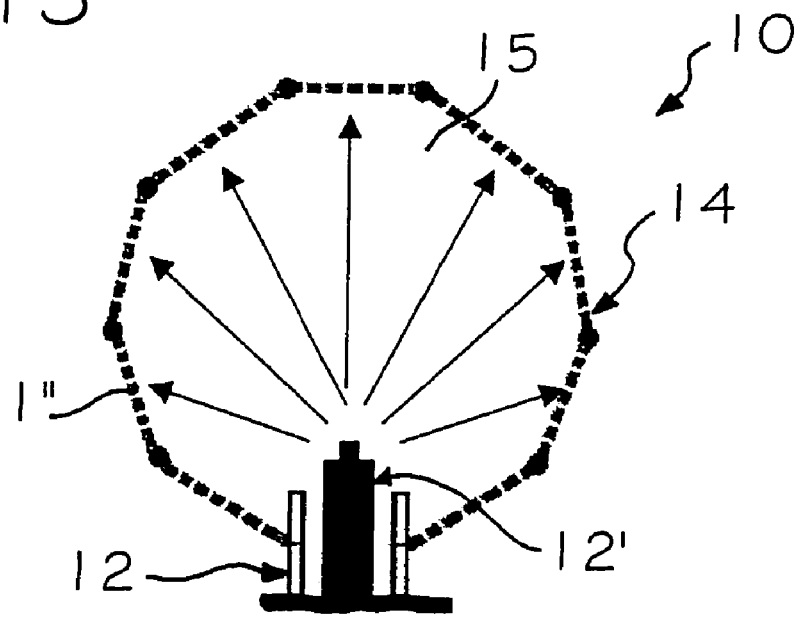
FIGS. 13 and 14 are partially sectioned and schematic illustrations of possible variants of the device illustrated in FIGS. 11 and 12.
Figure 14:
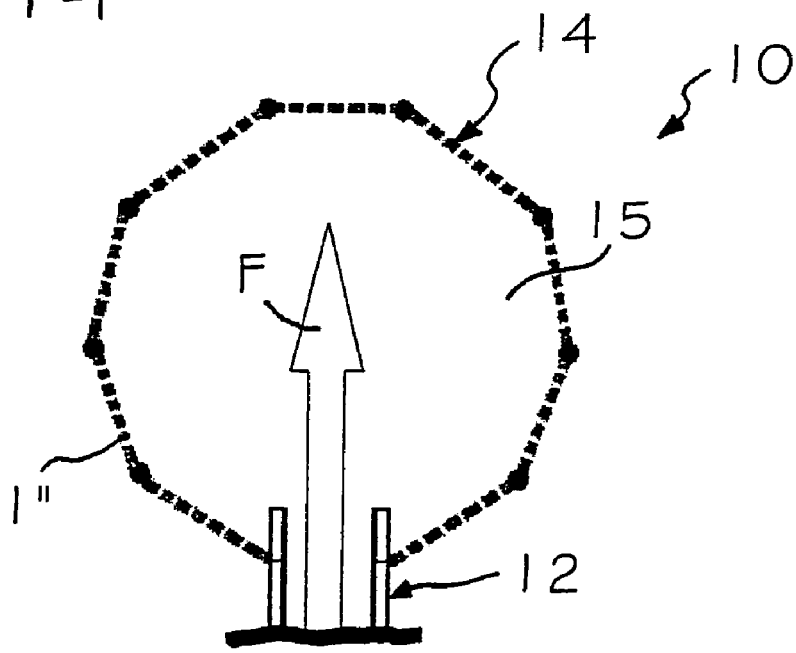

In the case of use of a fuel in the liquid state, injection of the fuel itself into the chamber 15 and into the micro-cavities 4 can be controlled via an arrangement of the ink-jet type, designated schematically by 12' in FIG. 13, forming part of the system of supply and conveyance 12. Alternatively, the porous material 1" used can be of a type suitable for enabling flow of a gaseous fuel in the micro-cavities 4, in which case a premixed gaseous flow will, for example, be introduced into the chamber 15, said flow being represented schematically by the arrow F of FIG. 14. Once again in the case of liquid fuel, injection of the fuel into the micro-cavities can be obtained by capillarity through a porous material of the ceramic type, vitreous type, metal type or wick type. Use of a cylindrical ceramic material having an elongated shape and segmented into two or more parts is, however, preferred for reasons of sturdiness and the possibility of controlling the flow of fuel electronically, electromechanically or manually. In effect, when the parts that make up the nanoporous cylinder are in contact, these enable passage of the fuel by capillarity. Instead, if parts of the cylinder are detached, the flow of fuel to the chamber for mixing the fuel and the comburent of combustion is stopped.

Switching on of the device 10, i.e., triggering of the combustion process within the micro-cavities 4, may be obtained in different ways. By way of non-exclusive example, the system 13 can be made in such a way that turning-on is obtained via a high-voltage electrical discharge between two electrodes, produced by piezoelectric elements, or else via a mechanical rubbing, or else again via incandescence of a metal element traversed by electric current.

Turning-off of the device for lighting via confined combustion is linked partly to the type of fuel used and partly to the system for supplying the latter. In the case of gaseous fuels, there may be envisaged for the purpose shutter means of the mechanical or electromechanical type, or solenoid-valve type, etc. In the case of liquid fuels, various kinds of systems may be provided; for example:

in the case where the supply system is based upon the ink-jet technique, turning-off of light emission is obtained via electrical de-activation of the supply system 12';

in the case of supply by capillarity, a mechanical shutter is integrated upstream or downstream of the supply system 12.

As explained above, by selecting appropriately the values of the parameters that define the properties of the porous structure, and in particular the diameter of the pores and the pitch of the grating, it is possible to prevent, or at least attenuate, spontaneous emission and propagation of radiation of given wavelengths, and enable simultaneously spontaneous emission and propagation of radiation of other given wavelengths. The confinement within the cavities performs a redistribution of the final states available for emission, with the photons which are emitted in the characteristic modes of the cavity.

In the above perspective, the grating can be made so as to determine a photonic band gap that will prevent spontaneous emission and propagation of infrared radiation, enabling at the same time the peak of spontaneous emission in the visible range to be obtained. For this purpose, for example, the diameter of the pores 4 of the film 1', 1" may be between 200 nm and 400 nm, preferably approximately 300 nm, and the pitch of the grating between 200 nm and 500 nm, preferably approximately 400 nm.

The use of anodized porous alumina is particularly advantageous for the implementation of the invention in so far as, as has been explained above, by an appropriate choice of the electrolyte and of the physical, chemical and electrochemical parameters of the process of fabrication, it is possible to obtain highly regular films of porous alumina, with the possibility of selecting the diameter of the pores 4, the sizes and density of the cells 3, as well as the depth of the film 1', 1".

The materials used for providing the porous structure, or in any case a structure provided with cavities or holes of nanometric radius (preferably 50-300 nm) may, however, be other than porous alumina, such as, for example, in the case of silicon semiconductors or dielectrics, $SiO_2$, and, in the case of metals, tungsten, tantalum, and molybdenum. Of course, the material chosen must have a high melting point.

From what has been described above, it may hence be appreciated how, in the device according to the invention, the characteristics of emission may be selected according to the requirements. The emitting device thus conceived hence finds advantageous application, for example, for the fabrication of light sources, luminescent devices and displays, large information panels for use in stadia, on motorways, or for advertising, and the like. The device may likewise be used for the fabrication of lamp bulbs for means for transport such as motor vehicles, heavy machinery (tractors or excavators), heavy vehicles, and, more in general, for the fabrication of any type of lamp, such as portable lamps for emergency lighting, for road signs, for general lighting, and in particular long-life self-contained fuel lamps, as an alternative to battery lamps or to fuel lamps for use on roads, on building sites, for industrial use, residential use, or for individual dwellings.

Of course, without prejudice to the principle of the invention, the details of construction and the embodiments may vary with respect to what is described and illustrated herein purely by way of example.

What is claimed is:

1. A lamp device having:

light emitting means;

a housing defining a chamber within which said light emitting means are at least partially arranged, said housing including a transparent body, wherein said chamber is adapted to receive a fuel and the lamp is further provided with means for supplying said fuel to said chamber, wherein said light emitting means comprise a structure including a catalytic material and defining an orderly series of cavities of submicrometric or nanometric dimensions, said cavities being at a mutual distance, having a respective diameter and having at least one end thereof which opens into said chamber, such that a process of catalytic combustion bring about light emission, and wherein at least one of the diameter and the mutual distance of the cavities is selected to prevent spontaneous emission and propagation of infrared radiation from said structure, while allowing spontaneous emission and propagation of visible radiation from the structure, which visible radiation can diffuse out of said chamber through said transparent body, wherein said cavities are arranged according to a grating having a pitch; and wherein the diameter of the cavities is between 200 nm and 400 nm and the pitch of the grating is between 200 nm and 500 nm.

2. The lamp device according to claim 1, wherein said cavities are longitudinally extended and are substantially parallel to each other in the structure.

3. The lamp device according to claim 1, wherein the diameter of said cavities and the pitch of said grating is selected to determine a photonic band gap that prevents and/or attenuates said spontaneous emission and propagation of infrared radiation from said structure.

4. The lamp device according to claim 1, wherein said catalytic material is a layer of said structure, which layer coats at least an inner surface of said cavities.

5. The device according to claim 1, wherein said structure comprises a film of anodized porous alumina.

6. The device according to claim 1, wherein said catalytic material is made of an inorganic material or of a combination of inorganic and organic material.

7. The device according to claim 6, wherein said catalytic material is selected in the group consisting of gold, platinum and palladium.

8. The device according to claim 1, wherein said structure is configured substantially as a photonic crystal structure.

9. The device according to claim 1, wherein said cavities are substantially in the form of holes that traverse said structure.

10. The device according to claim 1, wherein said chamber is designed for evaporation and mixing of the fuel and a supporter of combustion.

11. The device according to claim 1, wherein said supply means comprise at least one of an arrangement of the ink-jet type, means for introducing a gaseous flow into said chamber and means for injection by capillarity of a liquid fuel into said cavities.

12. The device according to claim 1, wherein said structure is at least in part formed by one of a dielectric material, a metal, and a semiconductor.

13. The device according to claim 1, further comprising ignition means.

14. The device according to claim 13, wherein said ignition means are operative for triggering said process of catalytic combustion within said micro-cavities via at least one of:

an electrical discharge between two electrodes;

a rubbing action or a mechanical pressure;

an electromechanical mechanism; and incandescence of an element traversed by electric current.

* * * * *